US007510215B2

(12) United States Patent
Lee

(10) Patent No.: US 7,510,215 B2
(45) Date of Patent: Mar. 31, 2009

(54) BOOK GRIP

(75) Inventor: Cheol Jae Lee, Seoul (KR)

(73) Assignee: Yong Cheol Jang (KR)

( * ) Notice: Subject to any disclaimer, the term of this patent is extended or adjusted under 35 U.S.C. 154(b) by 231 days.

(21) Appl. No.: 11/677,080

(22) Filed: Feb. 21, 2007

(65) Prior Publication Data

US 2008/0093837 A1 Apr. 24, 2008

(51) Int. Cl.
*B42D 17/00* (2006.01)

(52) U.S. Cl. ..... 281/46; 281/45; 281/42; 248/451

(58) Field of Classification Search ..... 281/15.1, 281/42, 45, 51, 33, 46; 40/658, 659; 24/67.11; 248/451, 452, 455
See application file for complete search history.

(56) References Cited

U.S. PATENT DOCUMENTS 1,888,773 A * 11/1932 Ruelland ..... 248/452
2,645,197 A * 7/1953 Jones et al. ..... 116/238
3,868,085 A * 2/1975 Bentley ..... 248/452
5,979,940 A * 11/1999 Araghi ..... 281/45
6,206,426 B1 * 3/2001 Azzato ..... 281/45
6,672,621 B1 * 1/2004 Moss ..... 281/36
6,895,888 B1 * 5/2005 Spillman ..... 116/238
7,237,756 B2 * 7/2007 Isenberg ..... 248/451

FOREIGN PATENT DOCUMENTS

GB 2203698 A * 10/1988

* cited by examiner

*Primary Examiner*—Dana Ross
*Assistant Examiner*—Jamila Williams
(74) *Attorney, Agent, or Firm*—Cantor Colburn LLP

(57) ABSTRACT

A book grip comprises a lower grip body formed with a first support projection, and defined with an upper grip body insertion opening; a upper grip body formed with a second support projection, having a lower end slidably inserted into the upper grip body insertion opening of the lower grip body, and defined with a page fastening clip installation hole; a handle installed on a rear surface of the lower grip body; a fastening string having one end supported by the second support projection and the other end extending over a distal end surface of the first support projection and supported by a length adjustment screw; and a page fastening clip having an elastic support part which supports a wide area of a page and a coupling part which is coupled into the page fastening clip installation hole of the upper grip body.

7 Claims, 9 Drawing Sheets

BOOK GRIP

BACKGROUND OF THE INVENTION

1. Field of the Invention

The present invention relates to a book grip which allows a book to be conveniently grasped by one hand, and more particularly, to a book grip which allows a person to easily read a book in a comfortable posture while the person moves or sits on a sofa.

2. Description of the Related Art

In general, when reading a book, it is not always necessary to place a book on a desk and read the book while sitting in a correct posture. That is to say, it is often the case that the book is held and read using one hand while walking or sitting on a sofa, etc.

However, when the book is opened to be read, since force for causing the book to be closed as in an initial state is applied due to the structure of the book, it is not easy to hold the book with one hand. Further, since the book has sharp edges, it is inconvenient to grasp the book.

Moreover, while the conventional book holder allows the book to be placed and conveniently viewed on a desk, because the book holder must be positioned on a flat surface, it cannot be properly used while moving or sitting on a sofa.

SUMMARY OF THE INVENTION

Accordingly, the present invention has been made in an effort to solve the problems occurring in the related art, and an object of the present invention is to provide a book grip which allows an opened book to be easily held by one hand and conveniently read in a comfortable posture.

In order to achieve the above object, according to the present invention, there is provided a book grip characterized in that an upper grip body, which is formed with a second support projection on the upper end of the front surface thereof, is slidably inserted into a rectangular lower grip body, which is formed with a first support projection on the lower end of the front surface thereof, a fastening string is installed between the first and second support projections, and a handle is provided to the rear surface of the lower grip body.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
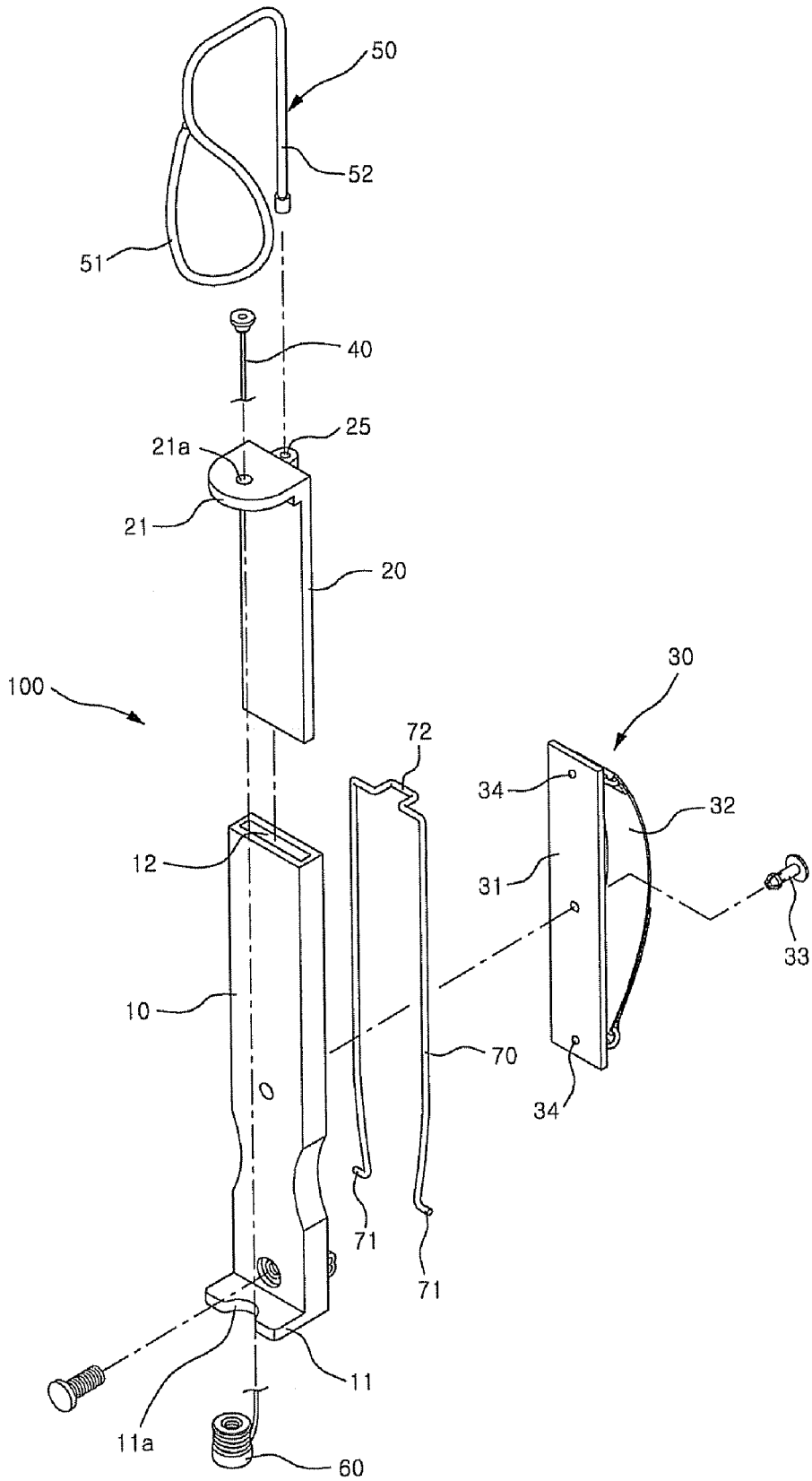
FIG. 1 is an exploded perspective view illustrating a book grip in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
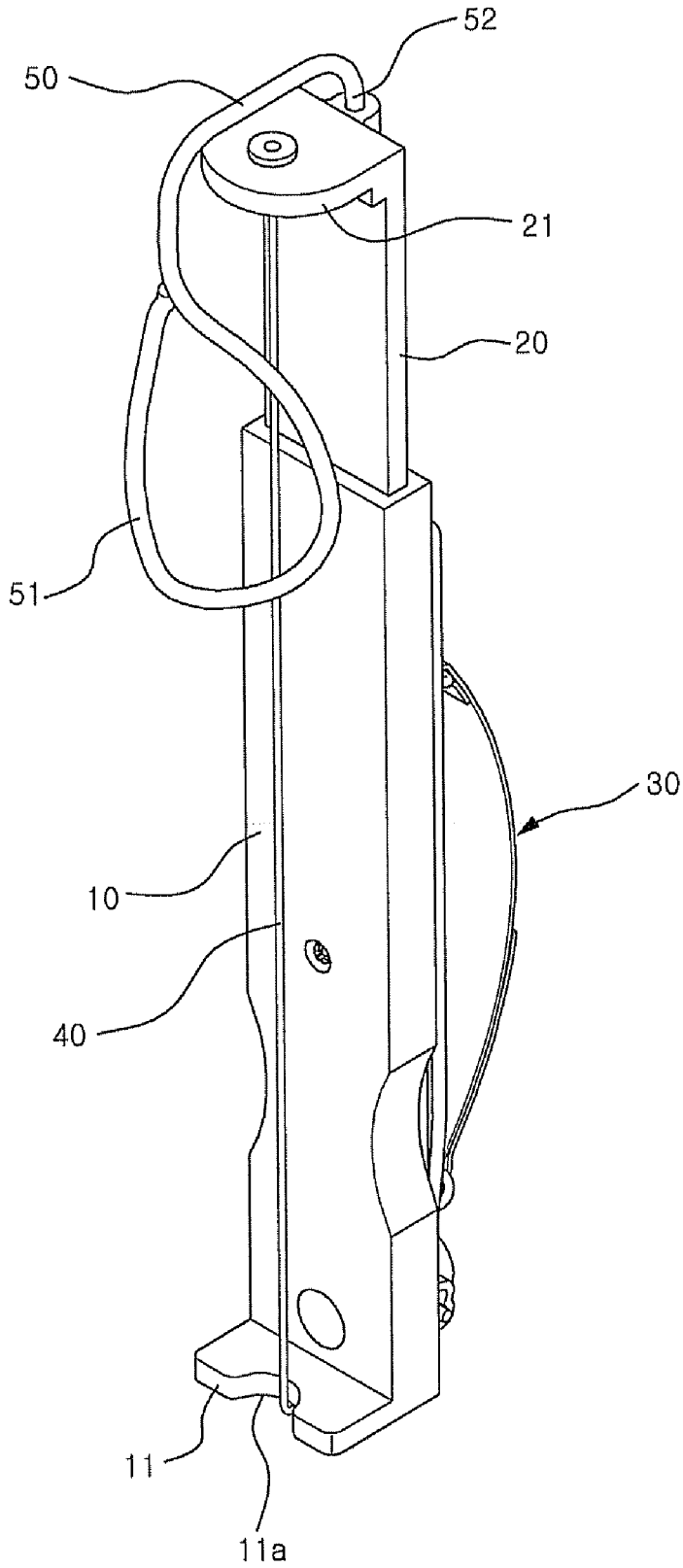
FIG. 2 is a front perspective view illustrating the book grip according to the present invention.
Figure 3:
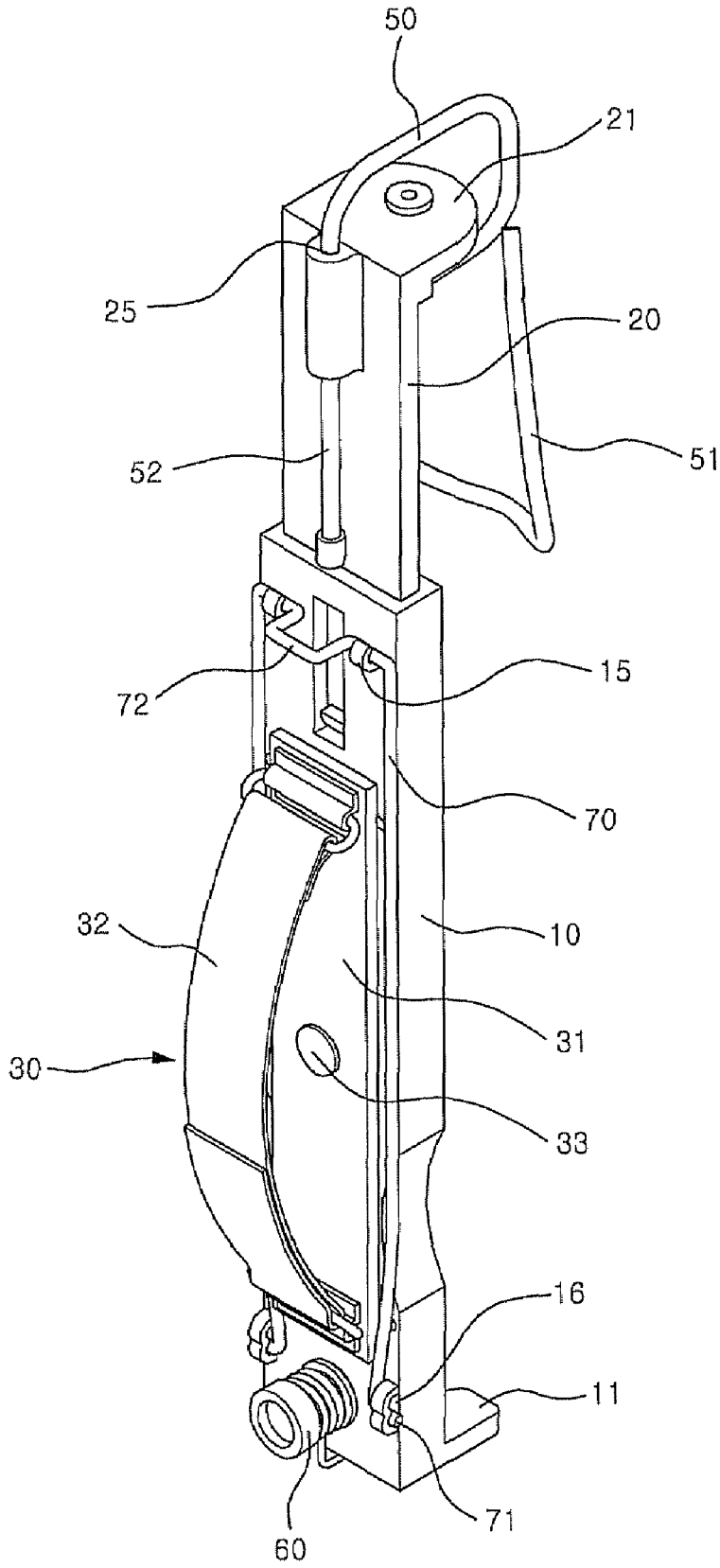
FIG. 3 is a rear perspective view illustrating the book grip according to the present invention.
Figure 4:
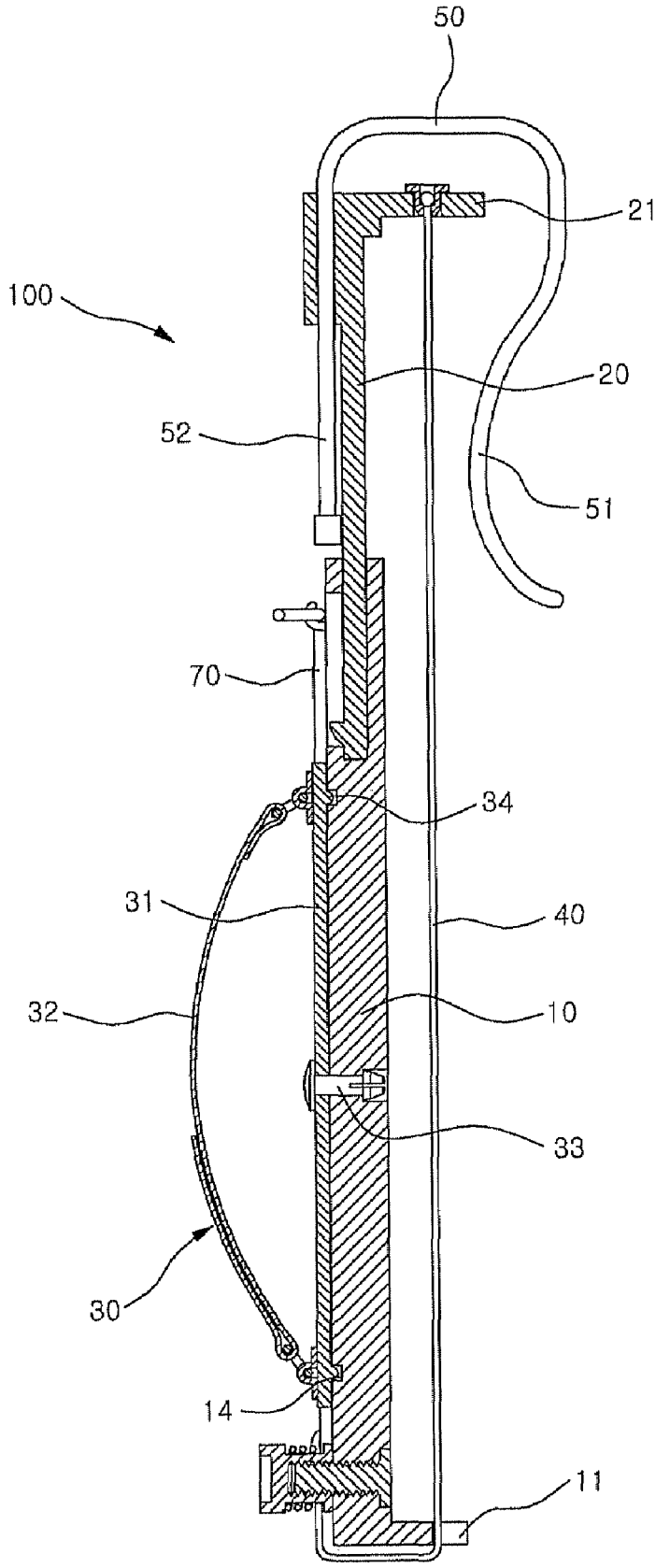
FIG. 4 is a longitudinal cross-sectional view illustrating the book grip according to the present invention.
Figure 5:
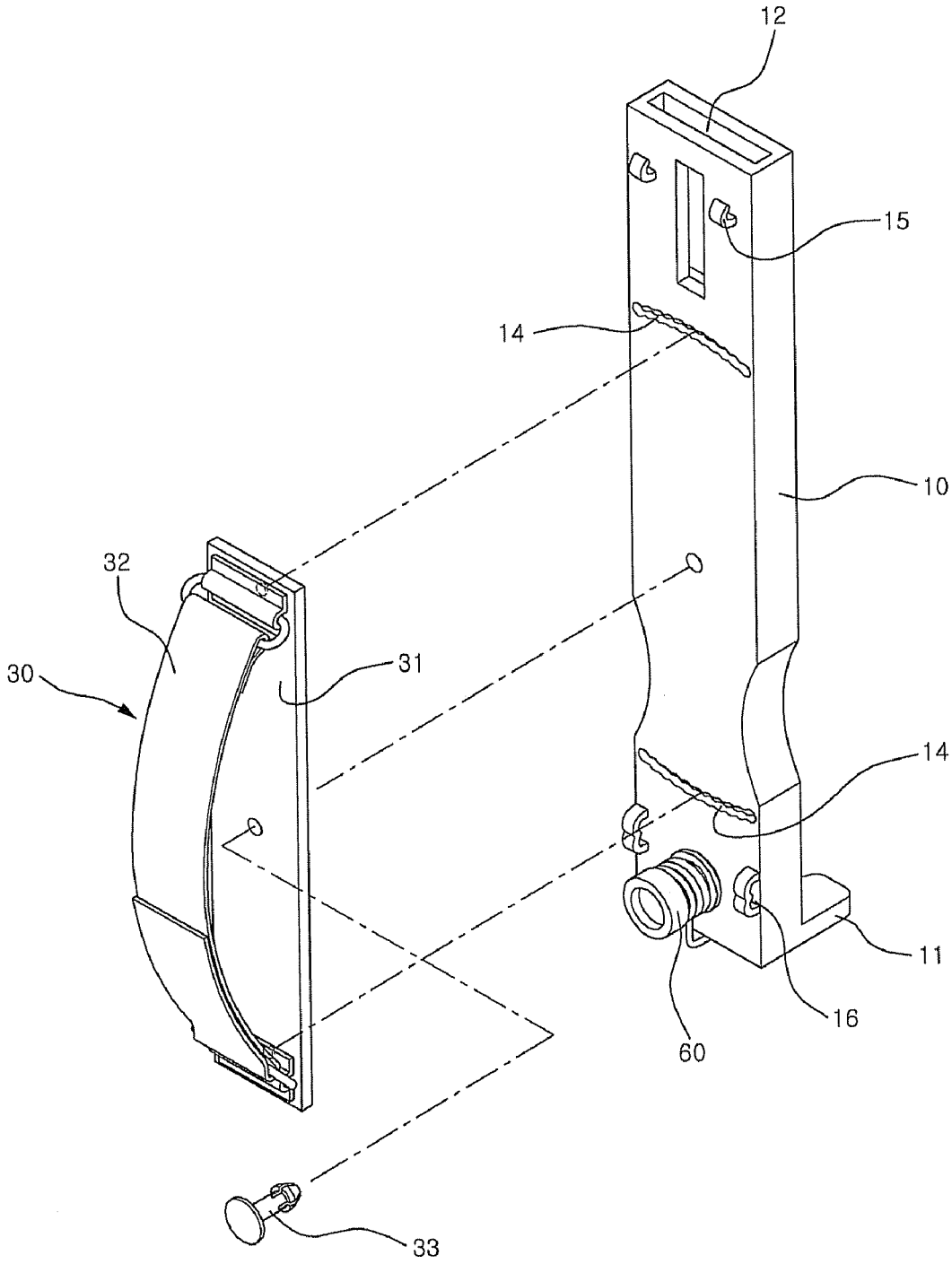
FIG. 5 is an exploded perspective view illustrating a strap and a lower grip body of the book grip according to the present invention.

FIG. 1 is an exploded perspective view illustrating a book grip in accordance with an embodiment of the present invention, FIG. 2 is a front perspective view illustrating the book grip according to the present invention, FIG. 3 is a rear perspective view illustrating the book grip according to the present invention, FIG. 4 is a longitudinal cross-sectional view illustrating the book grip according to the present invention, and FIG. 5 is an exploded perspective view illustrating a strap and a lower grip body of the book grip according to the present invention.

A book grip 100 in accordance with an embodiment of the present invention comprises a rectangular lower grip body 10, a rectangular upper grip body 20, a handle 30, a fastening string 40, and a page fastening clip 50. The rectangular lower grip body 10 is formed with a first support projection 11 on the lower end of the front surface thereof, and is defined with an upper grip body insertion opening 12 on the upper end thereof. The rectangular upper grip body 20 is formed with a second support projection 21 on the upper end of the front surface thereof, has a lower end which is slidably inserted into the upper grip body insertion opening 12 of the lower grip body 10, and is defined with a page fastening clip installation hole 25 on the rear surface thereof. The handle 30 is installed on the rear surface of the lower grip body 10. The fastening string 40 has one end which is supported by the second support projection 21 of the upper grip body 20, and the other end which extends over the distal end surface of the first support projection 11 of the lower grip body 10 and is supported by a length adjustment screw 60 installed on the lower end of the rear surface of the lower grip body 10. The page fastening clip 50 has an elastic support part 51 on the front portion thereof which supports a relatively wide area of a page and a coupling part 52 on the rear portion thereof which is coupled into the page fastening clip installation hole 25 of the upper grip body 20 to be extended out of and retracted into the page fastening clip installation hole 25.

In the illustrated embodiment, the handle 30 is composed of a front plate 31 and a rear band 32. The center portion of the front plate 31 is rotatably installed on the lower grip body 10 by a rotation pin 33. Engagement projections 34 are formed adjacent to the upper and lower ends of the front surface of the front plate 31, and multi-stepwise engagement grooves 14 into which the engagement projections 34 are respectively engaged are defined adjacent to the upper and lower ends of the rear surface of the lower grip body 10 so that the support angle of the handle 30 with respect to the lower grip body 10 can be adjusted within a predetermined angle.

In the present invention, it is preferred that the rear band 32 be adjusted in length through using Velcro-brand hook and loop fastener strips so that a space defined between the front plate 31 and the rear band 32 can be changed depending upon the size of a user's hand.

Further, in the illustrated embodiment, hooks 15 are formed on both sides adjacent to the upper end of the rear surface of the lower grip body 10, and fitting grooves 16 are defined on both sides adjacent to the lower end of the rear surface of the lower grip body 10. A support leg 70 has bent portions 71 which are formed on the lower end thereof to be respectively fitted into the fitting grooves 16, and a projected portion 72 which is formed on the upper end thereof. The support leg 70 is installed on the rear surface of the lower grip body 10 so that the support leg 70 can hold the book grip with a book 200 opened thereon in a state in which the book grip is erected or is stably supported by a portion of the human body.

Moreover, in the illustrated embodiment, a hole 21*a* is defined through the second support projection 21 of the upper grip body 20 to support one end of the fastening string 40, and a depression 11*a* is defined on the distal end surface of the first support projection 11 of the lower grip body 10 to prevent the fastening string 40 from being moved leftward or rightward.

In the present invention, it is preferred that the page fastening clip 50 and the support leg 70 be made of metal wire having a predetermined elasticity.

Figure 6:
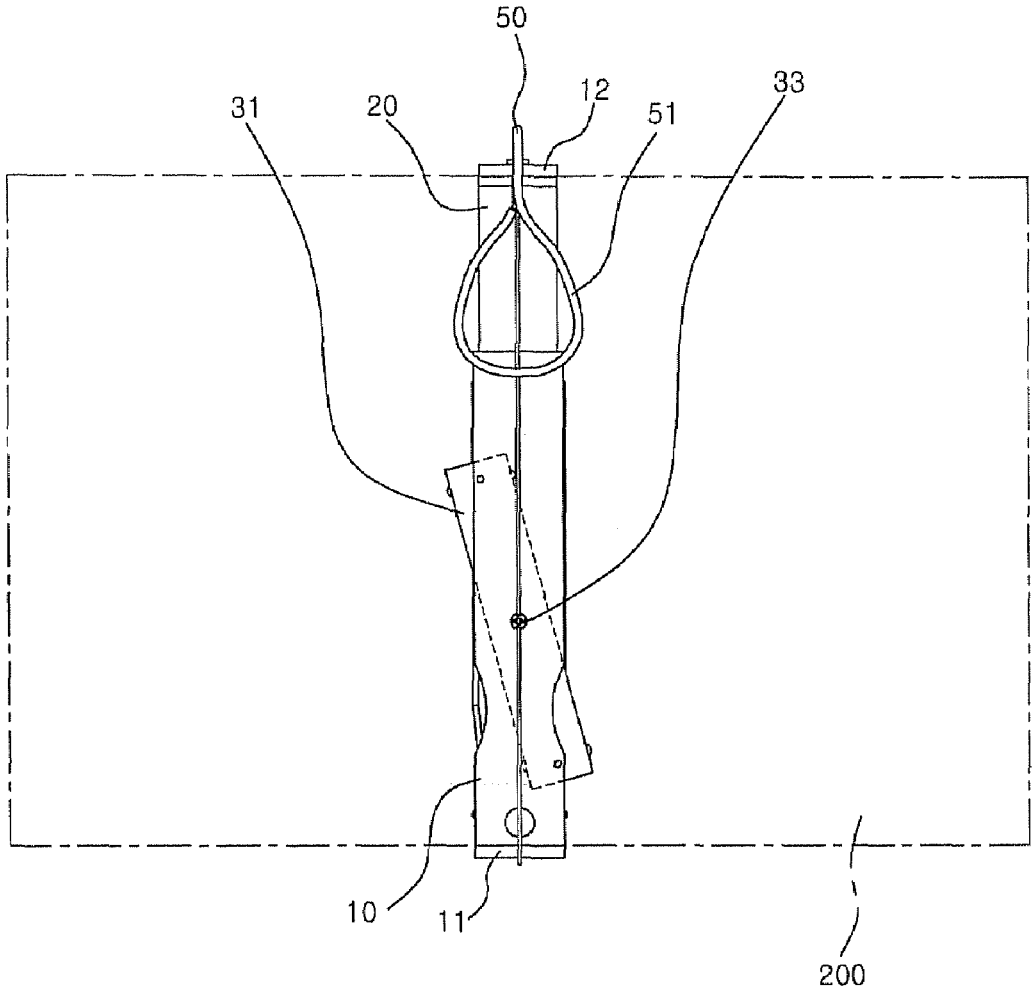
FIG. 6 is a front view illustrating an installed state of the book grip according to the present invention.
Figure 9:
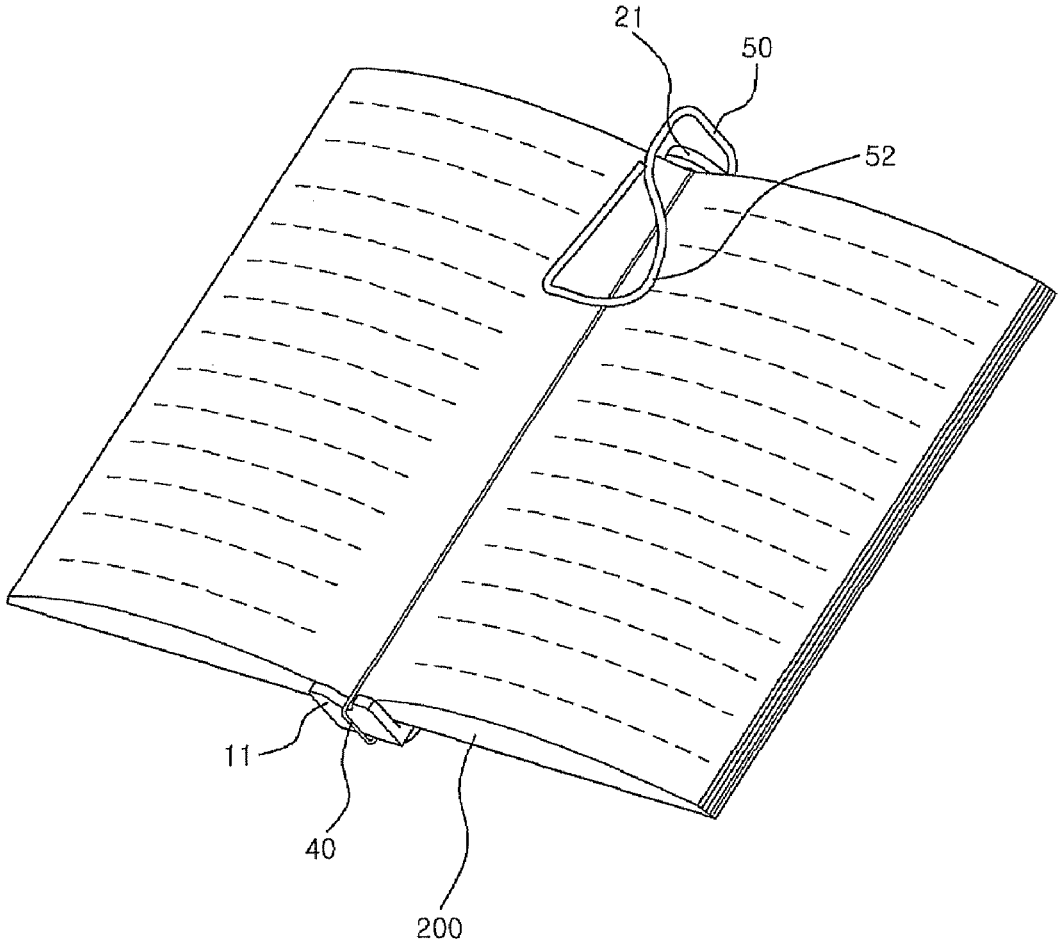
FIG. 9 is a perspective view illustrating the installed state of the book grip according to the present invention.

In the book grip according to the present invention, constructed as mentioned above, the upper grip body 20 is extended out of or retracted into the lower grip body 10 so that the distance between the first and second support projections 11 and 21 corresponds to the height of a book 200. Then, the book 200 is opened, inserted between the fastening string 40 and the lower and upper grip bodies 10 and 20, and moved so that the front surfaces of the lower and upper grip bodies 10 and 20 are brought into contact with the side surface, that is, the binding portion of the book 200. At this time, the upper and lower ends of the opened book 200 are supported by the first and second support projections 11 and 21, and the fastening string 40 is positioned on the center portion of the front surface of the book 200. Then, the page fastening clip 50 is lowered so that the support part 51 presses the upper portion of the front surface of the book 200. In this way, the book 200 can be stably supported in the opened state as shown in FIGS. 6 and 9. In this state, by inserting one hand into the handle 30 and supporting the lower grip body 10 by the palm of the hand, it is possible to conveniently hold and read the opened book 200.

In the present invention, when it is necessary to adjust the distance between the first and second support projections 11 and 21, length adjustment screw 60 can be unscrewed or screwed so that the length of the fastening string 40 can be adjusted. In the case of adjusting the support angle of the handle 30 with respect to the lower grip body 10 by rotating the handle 30 in one direction, the book 200 can be more conveniently held by the hand. When holding the book 200 using the left hand, by slightly rotating the handle 30 counterclockwise as shown in FIG. 6, the left hand can be obliquely inserted into the handle 30 and can conveniently hold the book 200. Also, when holding the book 200 using the right hand, by slightly rotating the handle 30 clockwise, the right hand can be obliquely inserted into the handle 30 and can conveniently hold the book 200.

Figure 7:
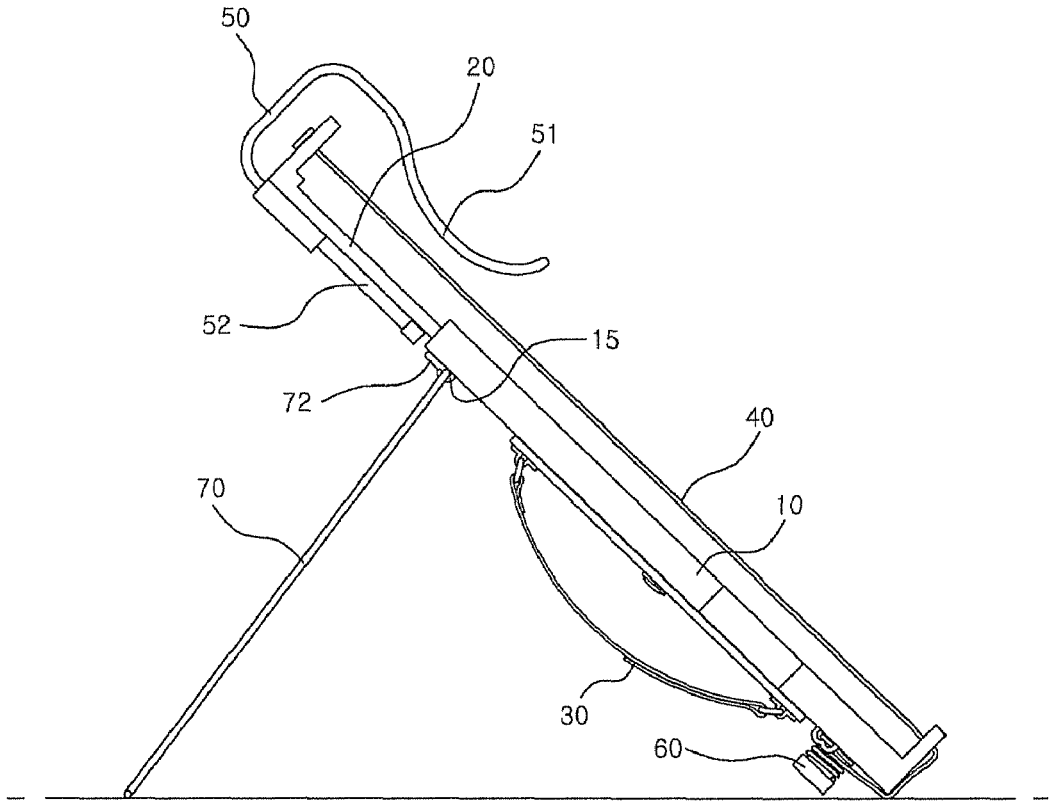
FIG. 7 is a side view illustrating an erected state of the book grip according to the present invention.
Figure 8:
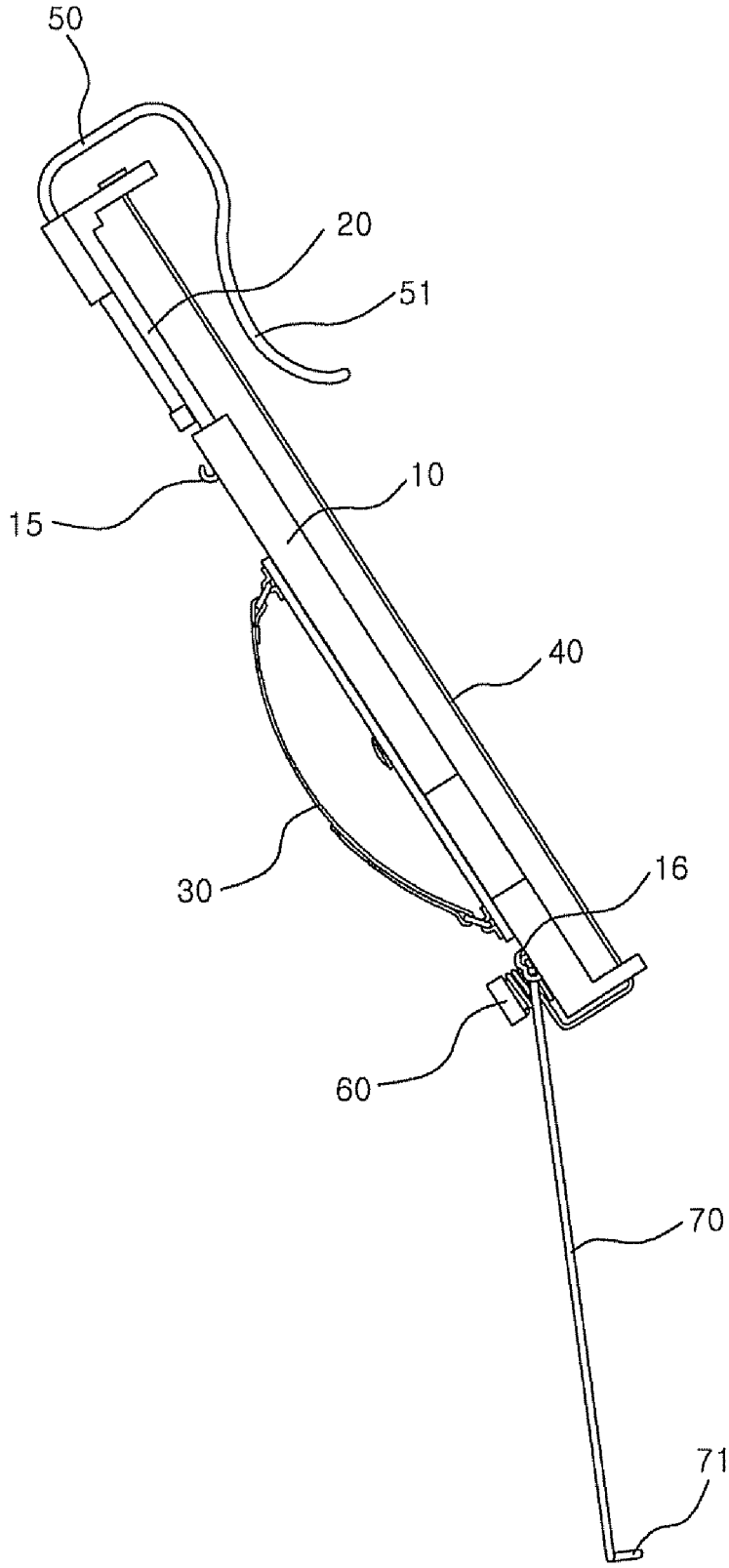
FIG. 8 is a side view illustrating a state in which the book grip according to the present invention is supported by a portion of the human body.

Meanwhile, in the case where the support leg 70 is installed on the rear surface of the lower grip body 10 as in the illustrated embodiment of the present invention, with the upper end of the support leg 70 coupled to the hooks 15 of the lower grip body 10, by placing the lower end of the support leg 70 which is separated from the lower grip body 10 and the lower end of the lower grip body 10 on the surface of a desk as shown in FIG. 7, it is possible to read the book 200 in an erected state as in the conventional book holder. In a state in which the bent portions 71 formed on the lower end of the support leg 70 are fitted into the fitting grooves 16 defined on both sides adjacent to the lower end of the rear surface of the lower grip body 10, if the upper end of the support leg 70 is rotated downward as shown in FIG. 8, the support leg 70 can be supported by the abdominal region or a portion of the human body when holding a heavy book using one hand. Therefore, the load of the book 200 can be dispersed, and the book 200 can be more stably held by the hand.

As is apparent from the above description, in the book grip according to the present invention, an upper grip body, which is formed with a second support projection on the upper end of the front surface thereof, is slidably inserted into a rectangular lower grip body, which is formed with a first support projection on the lower end of the front surface thereof. Further, a fastening string is installed between the first and second support projections, a handle is provided to the rear surface of the lower grip body, and a page fastening clip is installed on the upper grip body to be movable in upward and downward directions. As a consequence, according to the present invention, advantages are provided in that a person can easily open and read book with one hand while walking or sitting in a comfortable posture, whereby user convenience is significantly improved.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A book grip comprising:

a rectangular lower grip body formed with a first support projection on a lower end of a front surface thereof, and defined with an upper grip body insertion opening on an upper end thereof;

a rectangular upper grip body formed with a second support projection on an upper end of a front surface thereof, having a lower end which is slidably inserted into the upper grip body insertion opening of the lower grip body, and defined with a page fastening clip installation hole on a rear surface thereof;

a handle installed on a rear surface of the lower grip body;

a fastening string having one end which is supported by the second support projection of the upper grip body, and the other end which extends over a distal end surface of the first support projection of the lower grip body and is supported by a length adjustment screw installed on a lower end of a rear surface of the lower grip body; and a page fastening clip having an elastic support part on a front portion thereof which supports a wide area of a page and a coupling part on a rear portion thereof which is coupled into the page fastening clip installation hole of the upper grip body to be extended out of and retracted into the page fastening clip installation hole.

2. The book grip according to claim 1, wherein the handle is composed of a front plate and a rear band, a center portion of the front plate is rotatably installed on the lower grip body by a rotation pin, engagement projections are formed adjacent to upper and lower ends of a front surface of the front plate, and multi-stepwise engagement grooves into which the engagement projections are respectively engaged are defined adjacent to upper and lower ends of the rear surface of the lower grip body so that a support angle of the handle with respect to the lower grip body can be adjusted within a predetermined angle.

3. The book grip according to claims 1, wherein hooks are formed on both sides adjacent to an upper end of the rear surface of the lower grip body, and fitting grooves are defined on both sides adjacent to the lower end of the rear surface of the lower grip body, wherein a support leg has bent portions which are formed on a lower end thereof to be respectively fitted into the fitting grooves, and a projected portion which is formed on an upper end thereof, and wherein the support leg is installed on the rear surface of the lower grip body so that the support leg can hold the book grip with a book opened thereon in a state in which it is erected or it is supported by a portion of the human body.

4. The book grip according to claim 1, wherein a hole is defined through the second support projection of the upper grip body to support one end of the fastening string, and a depression is defined on the distal end surface of the first support projection of the lower grip body to prevent the fastening string from being moved leftward or rightward.

5. The book grip according to claim 2, wherein hooks are formed on both sides adjacent to an upper end of the rear surface of the lower grip body, and fitting grooves are defined on both sides adjacent to the lower end of the rear surface of the lower grip body, wherein a support leg has bent portions which are formed on a lower end thereof to be respectively fitted into the fitting grooves, and a projected portion which is formed on an upper end thereof, and wherein the support leg is installed on the rear surface of the lower grip body so that the support leg can hold the book grip with a book opened thereon in a state in which it is erected or it is supported by a portion of the human body.

6. The book grip according to claim 2, wherein a hole is defined through the second support projection of the upper grip body to support one end of the fastening string, and a depression is defined on the distal end surface of the first support projection of the lower grip body to prevent the fastening string from being moved leftward or rightward.

7. The book grip according to claim 3, wherein a hole is defined through the second support projection of the upper grip body to support one end of the fastening string, and a depression is defined on the distal end surface of the first support projection of the lower grip body to prevent the fastening string from being moved leftward or rightward.

* * * * *